US006450659B1

(12) United States Patent
Salatino

(10) Patent No.: US 6,450,659 B1
(45) Date of Patent: Sep. 17, 2002

(54) SKATE LIGHT ASSEMBLY

(76) Inventor: Brian J. Salatino, 8030 La Mesa Blvd., #324, La Mesa, CA (US) 91941

( * ) Notice: Subject to any disclaimer, the term of this patent is extended or adjusted under 35 U.S.C. 154(b) by 0 days.

(21) Appl. No.: 09/586,471

(22) Filed: Jun. 1, 2000

(51) Int. Cl.[7] ..... F21L 15/08
(52) U.S. Cl. ..... 362/103; 280/11.19
(58) Field of Search ..... 362/103; 36/136; 180/180; 280/11.19, 11.203

(56) References Cited

U.S. PATENT DOCUMENTS 5,516,149 A * 5/1996 Moore ..... 280/811
5,544,026 A * 8/1996 Holbrook ..... 362/103
5,716,119 A * 2/1998 Patel ..... 362/32
5,921,653 A * 7/1999 Chien ..... 362/103
6,238,055 B1 * 5/2001 Wallace ..... 362/103
RE37,220 E * 6/2001 Rapisarda et al. ..... 362/189
6,332,692 B1 * 12/2001 McCurdy ..... 362/103

* cited by examiner

*Primary Examiner*—Sandra O'Shea
*Assistant Examiner*—Anabel Ton
(74) *Attorney, Agent, or Firm*—Henri J. A. Charmasson; John D. Buchaca

(57) ABSTRACT

A roller skate has a light housed in a forward tip recess of a slab of synthetic material interposed between a boot and the roller truck. A lighted toggling push-button switch that espouses the back contour of the heel, can be activated by taping the back of the heel against the floor or any other stationary structure. The light comprises a battery compartment occupying the deepest area of the recess. A lens contoured to blend with the outline of the sole tip can be releasably snapped against the frontal opening of the battery compartment. A bulb-mounting assembly is held sandwiched between the lens and the battery compartment. The lights in the contoured tip lens and heel switch can be seen from either side of the skate.

10 Claims, 2 Drawing Sheets

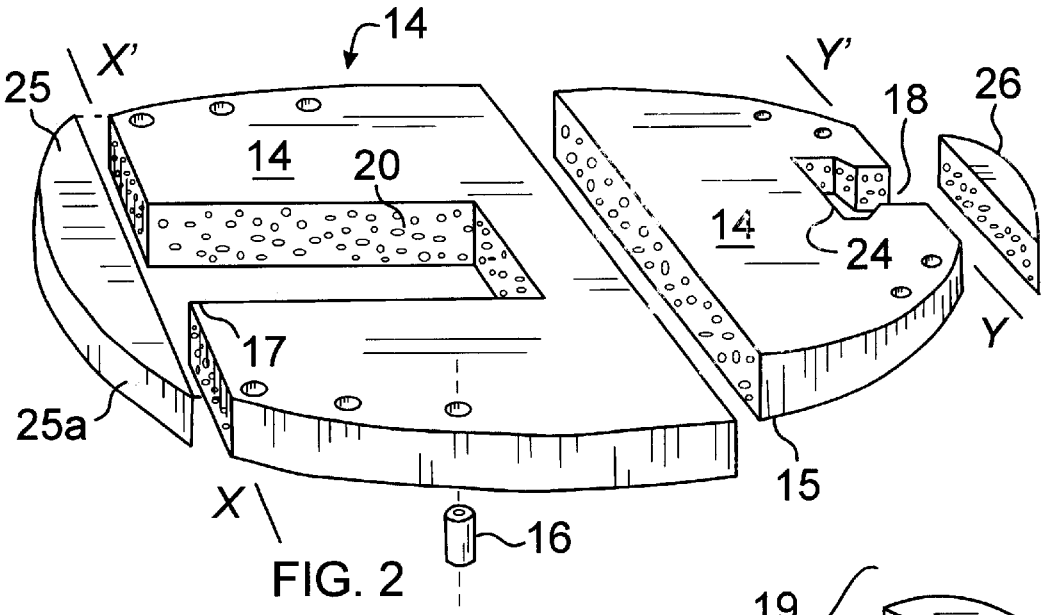
FIG. 2
FIG. 4
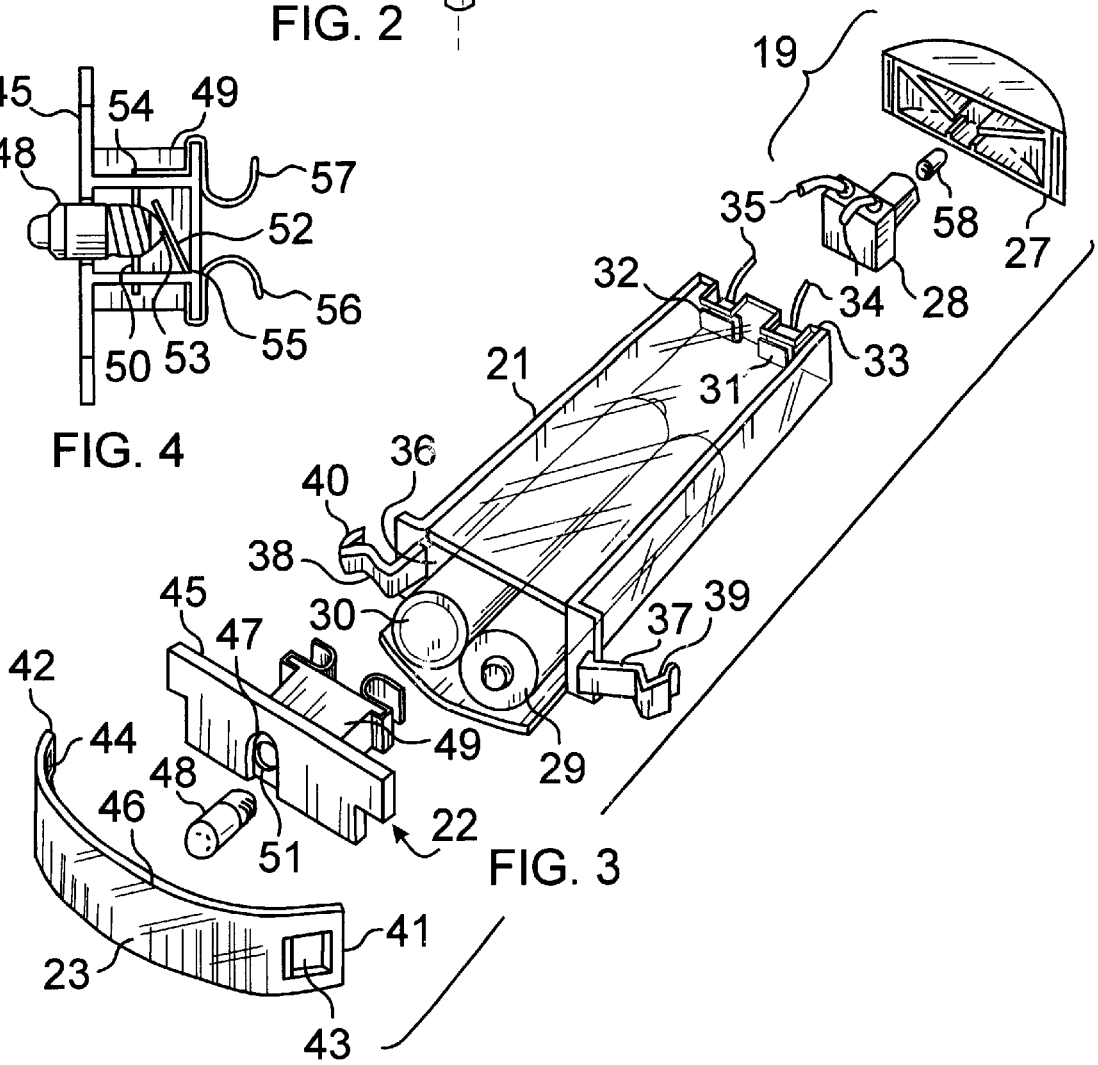
FIG. 3

SKATE LIGHT ASSEMBLY

FIELD OF THE INVENTION

This invention relates to light safety assembly for footwear, and more specifically to roller skates with built-in lights for night use.

BACKGROUND OF THE INVENTION

The development of highly practical and maneuverable inline roller skates that very closely mimic the feel and responsiveness of ice skates as contributed to a phenomenal increase in the popularity of this sporting implement. Adolescents and even adults are seen roller skating along roadways and on sidewalks at all hours of the day and night. Safety concerns have led to the addition of reflective patches and even light assemblies to roller skates. Lights can be incorporated in the original design of the skates as disclosed in U.S. Pat. No. 5,484,164 McInerney et al. The prior art also has provided light assemblies which can be added to existing skates as disclosed in U.S. Pat. No. 5,327,329 Stiles; U.S. Pat. No. 5,516,149 Moore; U.S. Pat. No. 4,367,515 Beard; U.S. Pat. No. 5,544,026 Holbrook; U.S. Pat. No. 5,552,971 Madden.

Those add-on light assemblies tend to be complex, difficult to install, and particularly unattractive. Furthermore, in most cases, they place the lights and activating switches in areas of the skates where they are very likely to be subject to damaging impacts by rocks, sidewalk curbs and other such hazards. There is a need for a new type of add-on lighting assemblies for skates that can be manufactured very economically, is practical to use and maintain, rugged, protected against damaging impacts, and inconspicuously blends with the general design of the skate in order to maintain a pleasant aesthetic appearance.

SUMMARY OF THE INVENTION

The principal and secondary objects of this invention are to provide a lighting assembly that is inexpensive to manufacture, and can be quickly incorporated between the boot, and the ground-contacting structure of the skate, be it a blade for contact with ice, a set of rollers, or any other low friction structure for supporting contact with a ground surface. These and other valuable objects are achieved by providing a light assembly in the shape of an insert whose outline follows closely the contour of the skate boot and has light fixtures mounted in both the rounded front tip and rounded heel. The light fixture at the heel portion of the skate acts as a toggle switch which can be activated by gently tapping the heel against a solid surface.

BRIEF DESCRIPTION OF THE DRAWING

FIG. 2 is a perspective view of the tip and heel sections of the light assembly;

FIG. 3 is a perspective exploded view of the light and switch assembly; and

FIG. 4 is bottom plan view of the front bulb-holding receptacle.

DESCRIPTION OF THE PREFERRED EMBODIMENT OF THE INVENTION

Figure 1:
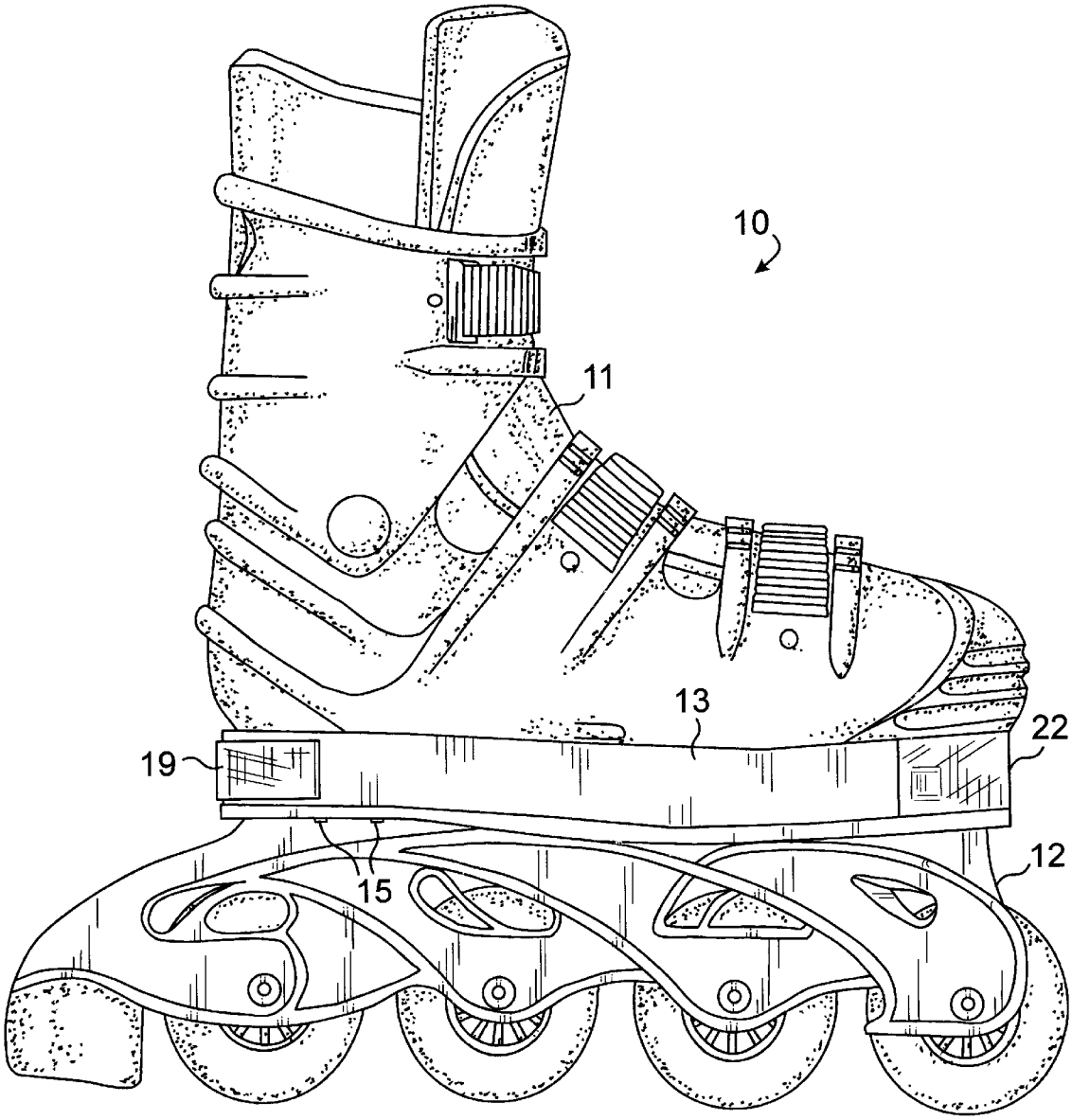
FIG. 1 is a right side view of an installed light-carrying roller skate assembly according to the invention.

Referring now to the drawing, there is illustrated in FIG. 1, a roller skate assembly 10 comprising a boot 11, a truck

12 of inline rollers, and a lighted insert 13 interposed between the boot and the truck. As shown in FIG. 2, the lighted insert is housed in a slab 14 of heavy duty synthetic foam whose outline follows closely the outline of the sole of the boot. The aforesaid boot, lighted insert and truck are held together by a set of rivets 15, nut-and-bolt fastener or other appropriate fasteners, passing through tubular stand-offs or spacers 16 having a length substantially equal to the thickness of the slab in order to prevent excessive compression of the slab, under the weight of the user.

As best illustrated in FIGS. 2 and 3, the slab 14 has a first cut-out 17 into the tip portion that forms a first cavity for housing a first light assembly 22. A second cut-out 18 in the heel portion forms a second cavity for housing a lighted switch assembly 19. The first cut-out 17 comprises a quadrangular rear section 20 that receives a battery housing 21 illustrated in FIG. 3. The front tip 25 of the central sole has been cut away along a transversal line X–X' in order to provide space for the first light assembly 22 and lens 23. The front of the lens 23 has the same radius of curvature as the front face 25*a* of the cut-away tip section 25. The heel cut-out section 18 forms a generally trapezoidal recess 24 to receive the rear light and toggling switch assembly 19. A small cut-off heel section 26 along another transversal line Y–Y' provides a recess for mounting the lighted portion of the switch and light assembly. The lens 27 of the rear light has the same radius of curvature as the backface of the cut-away heel section 26. When the back lens is in place, its outer surface 2 lies flush with the heel outline of the boot and appears as an extension thereof. Similarly, the arcuate shape of the lens 23 is designed to replace the missing tip portion of the slab. Thus its outline 46 harmoniously blends with the sole periphery. The bulb 58 for the rear light is mounted in the tip of the arm of the switch 28.

As detailed in FIGS. 3 and 4, the battery housing 21 can hold two side-by-side AA size batteries 29, 30. Two spring terminals 31, 32 mounted through he back wall 33 of the battery housing provide contacts with the positive pole of one of the batteries and the negative pole of the other. A pair of conductors 34, 35 connects these terminals to the terminals of the lighted switch 19. This wiring places the two bulbs 48, 58 and the switch 28 in series with the batteries.

Projecting from opposite sides of the battery housing frontal opening 36 are a pair of flexible prongs 37, 38. Each flexible prong has its distal end formed into a substantially quadrangular detent nib 39, 40. A pair of ears 41, 42 projecting from the side of the lens 23 have square holes 43, 44 which are shaped and positioned to capture the nibs 39, 40 associated with the battery housing 21. Thus, the lens 23 can be snapped into position by engaging the nibs 39, 40 through the holes 43, 44. In order to remove the lens 23 it suffices to squeeze between the thumb and index finger the part of the nibs protruding through the holes to slightly bend the flexible prongs 37, 38 until the lens is free.

Sandwiched between the lens 23 and the battery housing is the bulb-mounting assembly 22. This assembly comprises a panel 45 having a central cut-out 47 for passing the bulb 48 therethrough, and form a flange to a quadrangular box 49 acting as a socket for the bulb 48. A first terminal strip 50 has a hole 51 through which the bulb socket can be screwed. A second flexible terminal 42 comes in contact with the rear central terminal 53 of the bulb. Each terminal exits the box 49 through a pair of slots 54, 55 and terminates into opposite arcuate and resilient contact surfaces 56, 57 intended to come into electrical contact with the positive pole of one battery and the negative pole of another when the box is inserted into the battery housing 21. The bulb-mounting assembly is not secured in any way to the battery housing, but is simply held in place by the lens when the latter is retained by the detent nibs 39, 40. More specifically, the top and lateral edges of the panel 45 are clamped between the rim of the battery compartment opening 36 and the inner contour 46 of the lens. Accordingly, the removal of the lens 23 provides access to all the light components and for the replacement of the batteries or the bulb.

The back lens 27 is preferably colored red. The curvatures of both front and rear lenses make them visible from a transversal perspective. It should be noted that the switch 28 activates both the front and rear light assemblies.

While the preferred embodiment of the invention has been described, modifications can be made and other embodiments may be devised without departing from the spirit of the invention and the scope of the appended claims.

What is claimed is:

1. The combination of a skate with a light assembly wherein:

said skate comprises a low friction, ground-contacting structure for supporting contact with a ground surface, and an upper platform;

a boot mounted upon said platform, said boot comprising a sole having an outline defining a rounded frontal tip and a rounded heel;

said light assembly comprises a slab of synthetic material having substantially flat and parallel top and bottom surfaces and a peripheral outline substantially symmetrical with the outline of said sole, said slab having a frontal first cavity and a posterior second cavity;

a flashlight housed in said first cavity and having a first lens having an arcuate shape substantially congruent with said rounded tip, and closing said first cavity and positioned under said rounded frontal tip;

a switch assembly housed into said second cavity and having an actuator member closing said second cavity, and positioned under said rounded heel;

a pair of conductors connecting the switch assembly to the flashlight; and means for securing said light assembly between said platform and said boot;

wherein said light assembly comprises a toggling interrupter; and said actuator member comprises a push button.

2. The combination of claim 1, wherein said actuator member comprises a lighting assembly.

3. The combination of claim 2, wherein said lighting assembly comprises a bulb and a second lens cover covering said bulb.

4. The combination of claim 3, wherein said second lens has an arcuate shape substantially congruent with said rounded heel.

5. The combination of claim 1, wherein said ground-contacting structure comprises a set of rollers.

6. A skate which comprises a low friction, ground-contacting structure for supporting contact with a ground surface, said structure having an upper platform;

a boot comprising a sole having an outline defining a rounded frontal tip and a rounded heel;

a light assembly including a slab of synthetic material having substantially flat and parallel top and bottom surfaces and a peripheral outline substantially symmetrical with the outline of said sole, said slab having a frontal first cavity and a posterior second cavity;

a flashlight housed in said first cavity and having a first lens having an arcuate shape substantially congruent with said rounded tip, and closing said first cavity and positioned under said rounded frontal tip;

a switch assembly housed into said second cavity and having an actuator member closing said second cavity, and positioned under said rounded heel;

a pair of conductors connecting the switch assembly to the flashlight; and means for securing said light assembly between said platform and said boot;

wherein said light assembly comprises a toggling interrupter; and said actuator member comprises a push button.

7. The skate of claim 6, wherein said actuator member comprises a lighting assembly.

8. The skate of claim 7, wherein said lighting assembly comprises a bulb and a second lens cover covering said bulb.

9. The skate of claim 8, wherein said second lens has an arcuate shape substantially congruent with said rounded heel.

10. The skate of claim 6, wherein said ground-contacting structure comprises a set of rollers.

* * * * *